US007033218B2

(12) United States Patent
Huang et al.

(10) Patent No.: US 7,033,218 B2
(45) Date of Patent: Apr. 25, 2006

(54) ELECTRICAL CONNECTOR WITH LOCKING DEVICE

(75) Inventors: Shang-Yen Huang, Taipei Hsien (TW); Sheng-Ho Yang, Taipei Hsien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 10/920,308

(22) Filed: Aug. 18, 2004

(65) Prior Publication Data

US 2005/0245132 A1 Nov. 3, 2005

(30) Foreign Application Priority Data

Apr. 30, 2004 (TW) ..... 93206754 U

(51) Int. Cl.
*H01R 13/648* (2006.01)

(52) U.S. Cl. ..... 439/607; 439/353

(58) Field of Classification Search ..... 439/350, 439/353, 354, 357, 607
See application file for complete search history.

(56) References Cited

U.S. PATENT DOCUMENTS

| | | | | |
|---|---|---|---|---|
| 5,397,246 | A * | 3/1995 | Defibaugh et al. | 439/352 |
| 5,660,558 | A * | 8/1997 | Osanai et al. | 439/353 |
| 6,394,842 | B1 * | 5/2002 | Sakurai et al. | 439/607 |
| 6,863,556 | B1 * | 3/2005 | Viklund et al. | 439/354 |

* cited by examiner

*Primary Examiner*—Khiem Nguyen
(74) *Attorney, Agent, or Firm*—Troxell Law Office, PLLC

(57) ABSTRACT

An electrical connector assembly comprises a first connector including a locking device constructed by utilizing the principles of leverage, a metal case, a plastic housing, and a first conductor assembly; and a second connector coupled to one end of the first connector. The locking device comprises an insulating base, a support, a second conductor assembly, and a U-shaped flexible member including a transverse member and two resilient members. The insulating base comprises a U-shaped tunnel formed at either side thereof, An elongated trough is formed along either side of the support, the troughs and the tunnels being coupled together to form a ground for resting the resilient members thereon when the insulating base and the support are coupled together. The second connector comprises a slit in either side for locking the locking device. The invention can effect a reliable electrical connection.

8 Claims, 6 Drawing Sheets

ELECTRICAL CONNECTOR WITH LOCKING DEVICE

BACKGROUND OF THE INVENTION

1. Field of the Invention

The present invention relates to electrical connectors and more particularly to a mini-USB type electrical connector having a locking device.

2. Description of Related Art

Reliable fastening of an electrical connector in a port or to a mated connector is very important. For example, a mini-USB type electrical connector comprises a projection (or so-called male connector) and a port (or so-called female connector). Each of the male and female connectors comprises an insulating body, a conductor assembly in the body, and a metal housing for enclosing the body.

However, the coupled male and female connectors tend to become loose because for example the male connector, attached to a cable, is provided external to the coupled device and is thus subject to disengagement by pulling the cable. This can cause a poor electrical contact. It is understood that the times of plugging and/or unplugging the mini-USB type electrical connector is larger than that of a conventional electrical connector. Thus, the mini-USB type electrical connector incorporating the conventional construction cannot ensure a reliable connection because a resilient member of the male connector may suffer elastic fatigue after a predetermined times of use and the coupling of the male and female connectors may be compromised by inadvertently pulling the cable. Thus, continuing improvements in the exploitation of electrical connector are constantly being sought.

SUMMARY OF THE INVENTION

It is an object of the present invention to provide an electrical connector having a locking device constructed by utilizing the principles of leverage so that the electrical connector can be secured to a mated connector.

It is another object of the present invention to provide an electrical connector having a reliable, durable locking device so that an inadvertent pulling of the cable coupled to the electrical connector will not compromise the electrical connection of the coupled electrical connector and the mated connector.

To achieve the above and other objects, the present invention provides an electrical connector assembly comprising a first connector including a locking device, a metal case, a plastic housing, and a first conductor assembly; and a second connector, wherein the locking device comprises a structure including an insulating base, a support, and a second conductor assembly, and a U-shaped flexible member including a transverse member and two resilient members, the insulating base comprises a U-shaped tunnel formed at either side thereof, an elongated trough is formed along either side of the support, the troughs and the tunnels being coupled together to form a ground for resting the resilient members thereon when the insulating base and the support are coupled together, and the second connector comprises a slit in either side for locking the locking device.

The above and other objects, features and advantages of the present invention will become apparent from the following detailed description taken with the accompanying drawings.

DETAILED DESCRIPTION OF THE PREFERRED EMBODIMENTS

Figure 1:
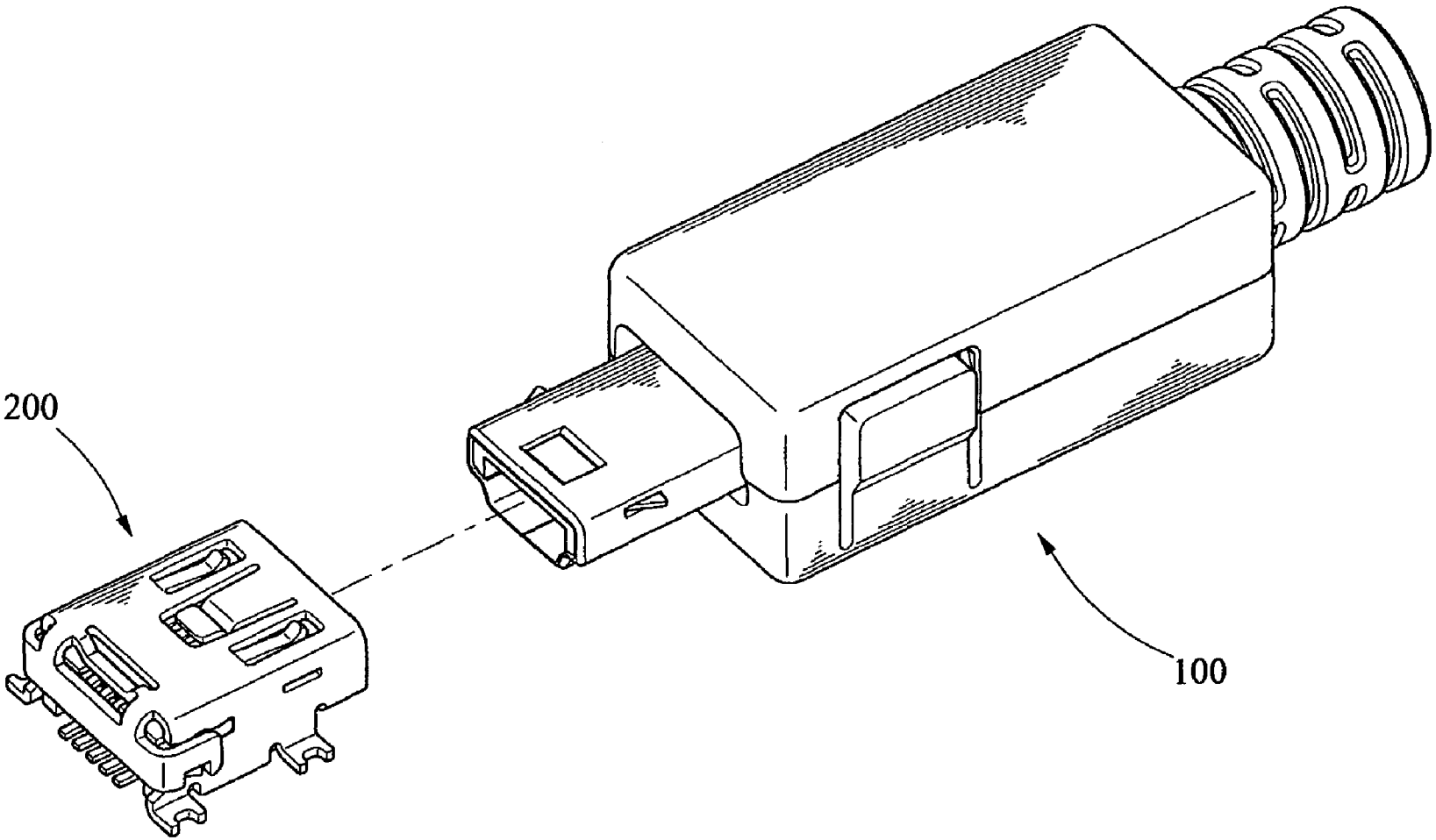
FIG. 1 is an exploded perspective view of a preferred embodiment of electrical connector assembly according to the invention.
Figure 2:
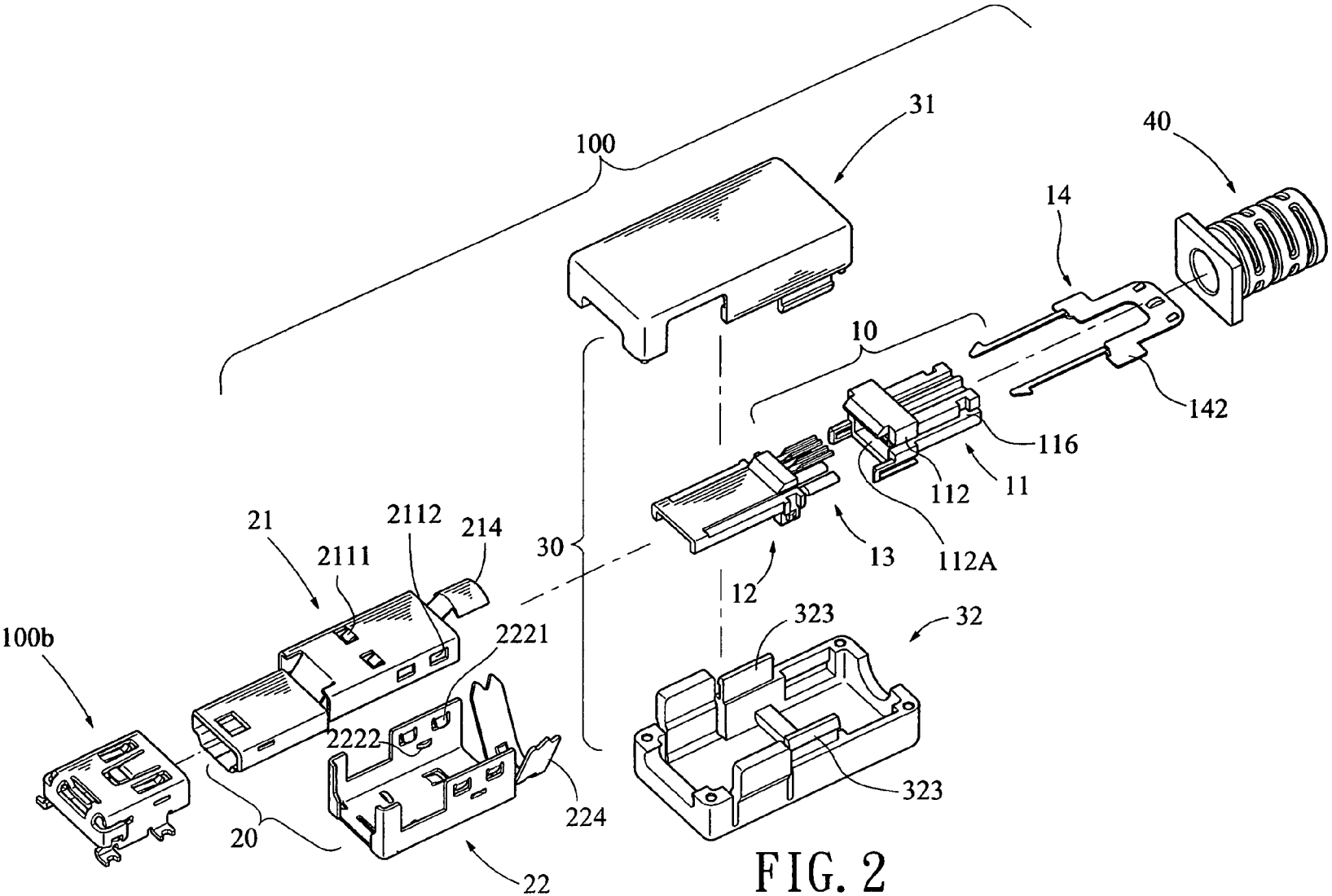
FIG. 2 is an exploded perspective view of the electrical connector assembly of FIG. 1.

Referring to FIGS. 1 and 2, there is shown an electrical connector assembly constructed in accordance with a preferred embodiment of the invention. The electrical connector assembly comprises a connector 100 coupled to conductors (i.e., cable) at one end and a second connector 100*b* coupled to the other end of the connector 100. The connector 100 comprises a locking device 10, a metal case 20, a plastic housing 30, and a cable enlargement 40. The locking device 10 comprises an insulating base 11, a support 12, a conductor assembly 13, and a U-shaped flexible member 14. The case 20 comprises an inner case 21 and an outer case 22. The housing 30 comprises an upper shell 31 and a lower shell 32.

Figure 3:
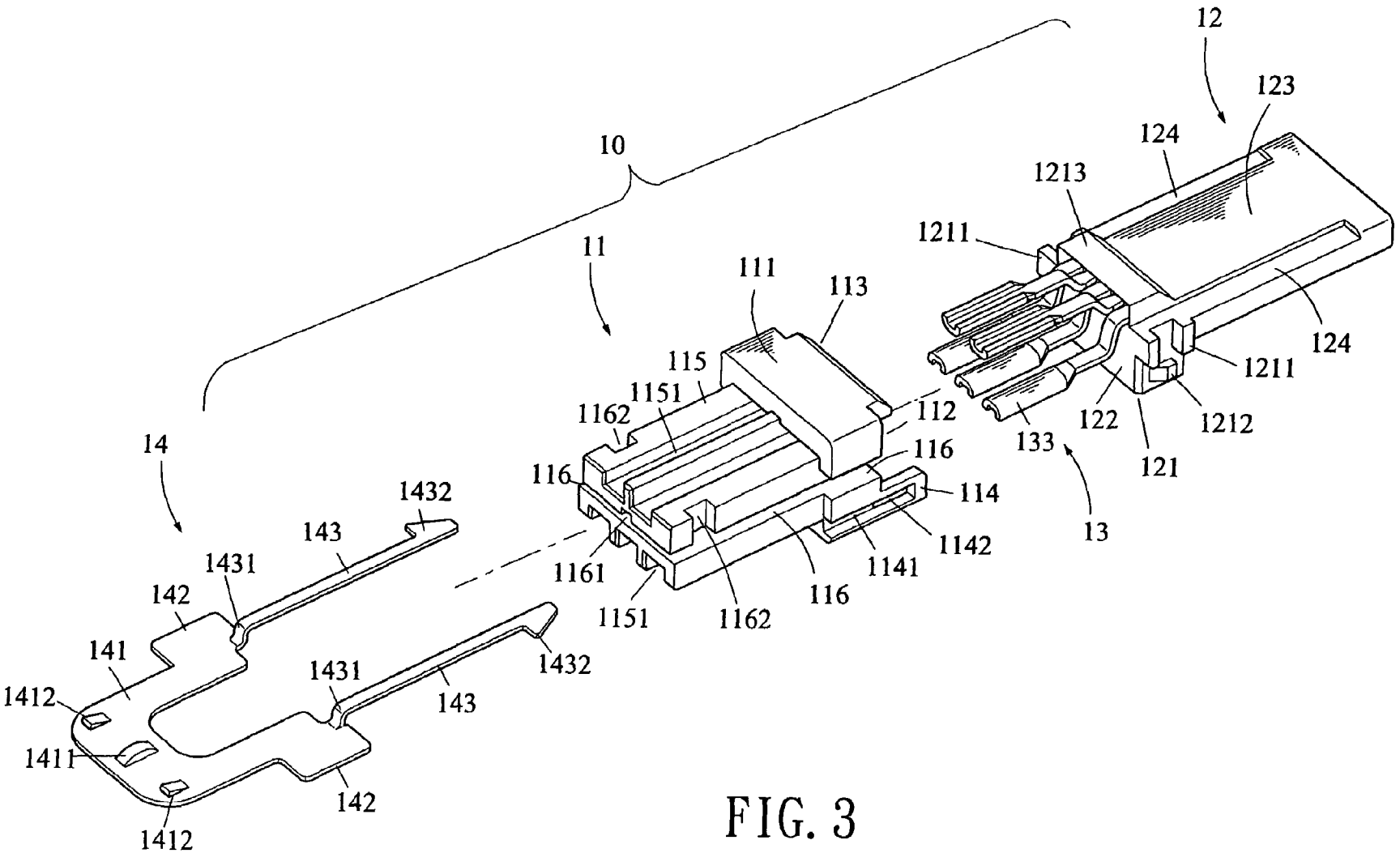
FIG. 3 is an exploded perspective view of the locking device shown in FIG. 2.

Referring to FIGS. 3 and 4, the base 11 is a rectangular member and comprises an upper body 111 including a connecting element 112 and a forward extension 113, a lower plate 115 including a plurality of parallel top and bottom channels 1151 in communication with a cavity (not shown) in the body 111, a bent positioning member 114 at either side, a groove 1141 formed at a middle portion of the positioning member 114, and a slot 1142 formed at one end of the groove 1141. In a case of the base 11 coupled to the support 12, a plurality of parallel soldered members 133 of the conductor assembly 13 insert through the cavity 112A (see FIG. 2) of the body 111 into the channels 1151. A U-shaped tunnel 116 is formed at either side of the plate 115 to divide the plate 115 into upper and lower sections. A lengthwise, central passageway 1161 is formed on the plate 115 to be in communication with the tunnel 116. An indent 1162 is provided at either side of the plate 115.

The support 12 and conductor assembly 13 of the locking device 10 are formed integrally by insert molding. The support 12 comprises a rear seat 121 and a front board 123. The seat 121 comprises a tab 1211 and a projection 1212 both at either side. In a case of a connecting element 122 coupled to the connecting element 112 of the base 11, the projections 1212 are inserted into the slots 1142 for fastening the support 12 and the base 11 together. Also, the tabs 1211 are urged against junctures 1431 of the flexible member 14 (see FIG. 3). Roof 1213 of the support 12 is urged against the extension 113 so as to couple the conductor assembly 13 and the base 11 together. An elongated trough 124 is provided along either side of a bottom of the support 12. The troughs 124 are matingly engaged with the tunnels 116.

The U-shaped flexible member 14 is adapted to dispose on the troughs 124 and the tunnels 116. The flexible member 14 comprises a transverse member 141 including a central, raised portion 1411 matingly coupled to the passageway

1161 and two side protrusions 1412 matingly coupled to the indents 1162, two parallel branches 142 extended from the transverse member 141, and two elongated resilient members 143 each coupled to the branch 142 by the juncture 1431. A latch 1432 is formed at an end of the resilient member 143. The bent juncture 1431 is pressed to form a flat one when the resilient member 143 is inserted into the tunnel 116 on the trough 124.

Figure 5:
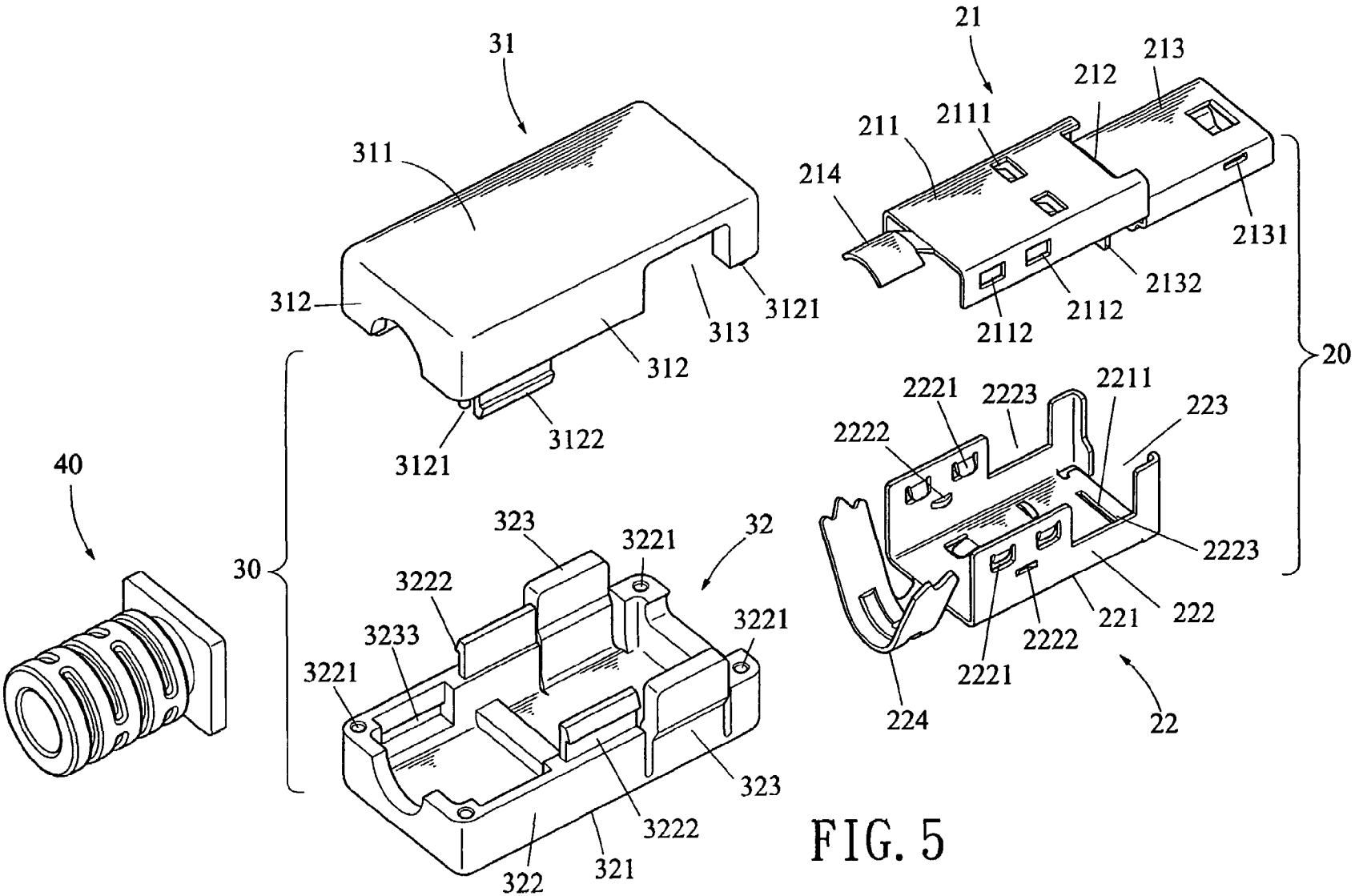
FIG. 5 is an exploded perspective view of the case and the housing.

Referring to FIG. 5, the inner case 21 comprises a rear member 211, a front member 213, and a ramp 212 for connecting the front and rear members 213 and 211 together. An arcuate member 214 is formed in one end of the rear member 211. A space is defined by the front member 213 to receive the support 12. A slit 2131 is provided at either side of the front member 213. The latches 1432 are adapted to project from the slits 2131 for fastening the locking device 10. A rib 2132 is provided on a bottom of the front member 213. The rib 2132 is adapted to insert into an elongated opening 2211 for fastening the inner and outer cases 21 and 22 together. The rear member 211 has a section of n and comprises two latches 2111 urged against an inner surface of the body 111. Two openings 2112 are provided on either side of the rear member 211. Either pair of side latches 2221 of the outer case 22 are adapted to insert into the openings 2112 for fasten the inner and outer cases 21 and 22 together.

The outer case 22 comprises a tab 2222 provided at either side of an inner surface, a recess 2223 provided at either side with the branch 142 slidably disposed thereon, a front opening 223 shaped to substantially match the shape the front member 213, and a rear bent member 224 together with the arcuate member 214 to clamp the cable when the inner and outer cases 21 and 22 are coupled together.

The housing 30 is adapted to enclose the inner and outer cases 21 and 22 except the front member 213. The upper shell 31 comprises a detent 3122 extended downwardly from either side wall 312, four corner pegs 3121, a cavity 313, and a well (not shown) both at either side wall 312. The mated lower shell 32 comprises four corner holes 3221 with the pegs 3121 inserted thereinto, a latch 3222, a well 3233, and a detent 323 all at either side, the latch 3222, the well 3233, and the detent 323 being coupled to the well, the latch 3122, and the cavity 313 of the upper shell 31 respectively. This forms a complete housing 30. Also, a neck of the typical cable enlargement 40 is secured by the rears of the upper and lower shells 32.

Figure 6:
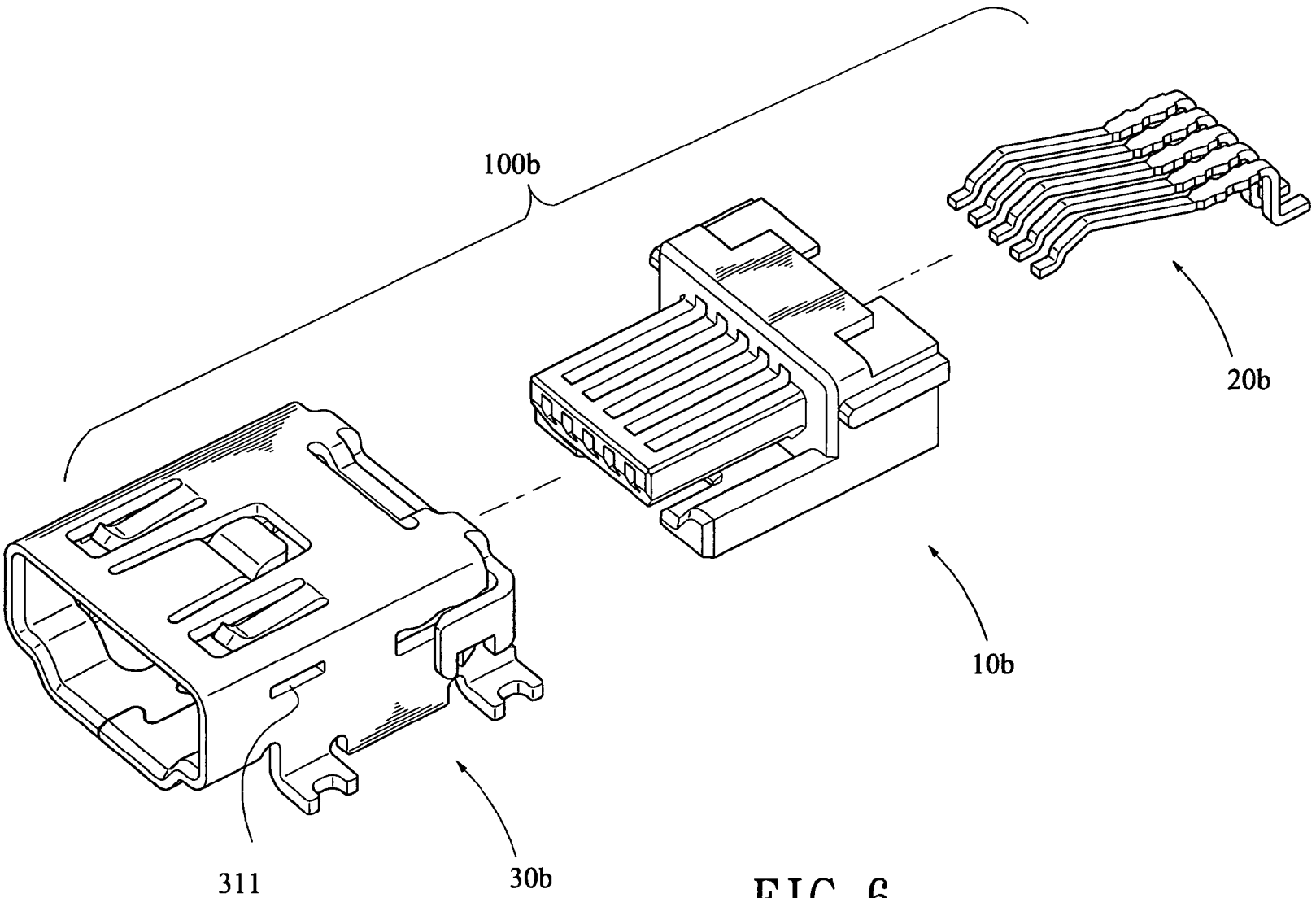
FIG. 6 is an exploded perspective view of the second connector.

Referring to FIG. 6, the second connector **100*b* is adapted to couple to the connector 100 and comprises an insulating seat 10*b*, a conductor assembly 20*b*, and a metal case 30*b*. The case 30*b* comprises a slit 311*b* in either side with the latch 1432 projected therefrom (i.e., locked) when the second connector 100*b* and the connector 10 are coupled together. As the detail descriptions of the second connector 100*b*** has been disclosed in U.S. Pat. No. 6,659,799, for the sake of simplicity, the relevant descriptions thereof are thus omitted.

Figure 4A:
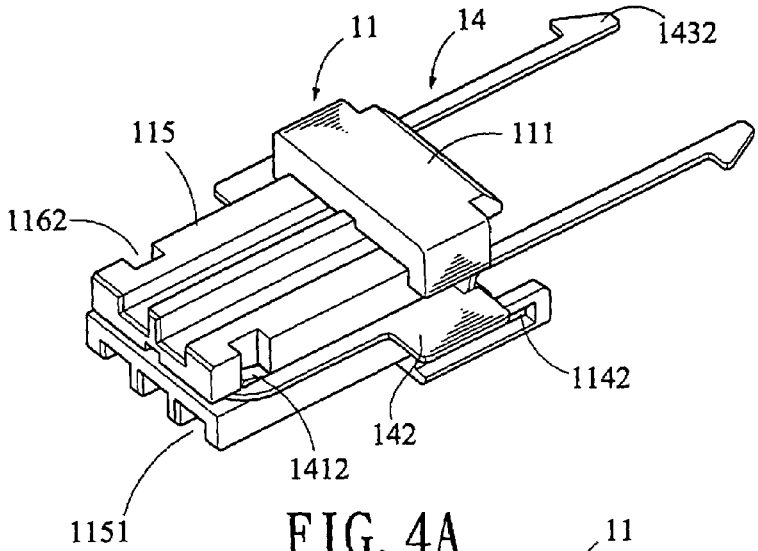
FIGS. 4A to 4C are perspective views showing steps of assembling the locking device shown in FIG. 2.
Figure 4B:
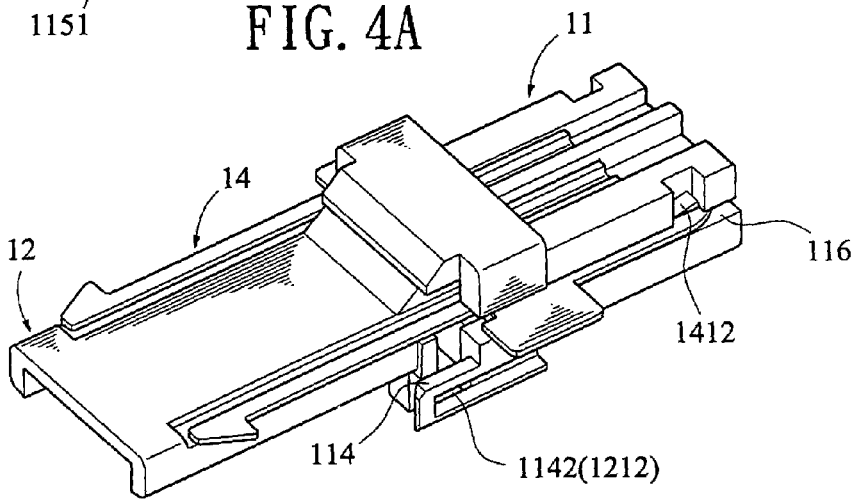
Figure 4C:
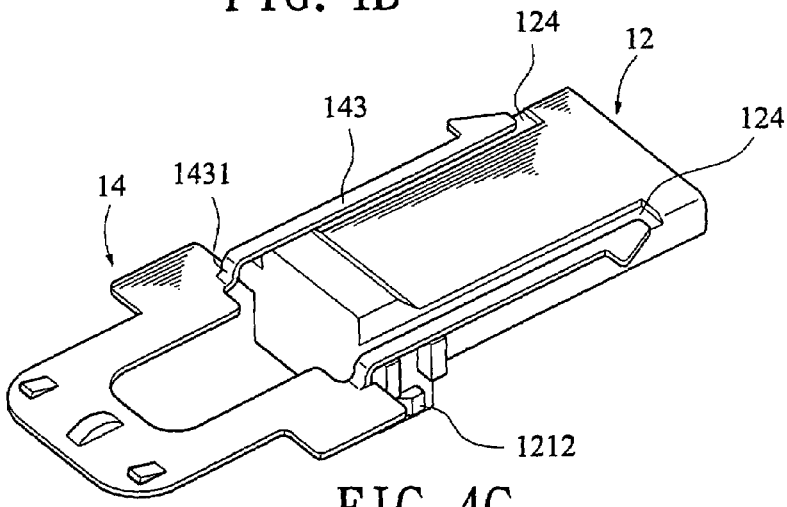

An assembly of the invention will be described in detailed below with reference to FIGS. 1 to 5. Firstly, place the flexible member 14 on the tunnels 116 of the base 11, as shown in FIG. 4A. Urge the support 12 against the base 11 with the projections 1212 inserted into the slots 1142 for fastening the support 12 and the base 11 together (see FIG. 4B). In this manner, two elongated resilient members 143 with the bent juncture 1431 of the flexible member 14 are rested on two troughs 124 of the support 12 as shown in FIG. 4C. Secondly, couple the inner case 21 and the above assembled components together. Then couple the inner case 21 and the outer case 22 together with the side latches 2221 of the outer case 22 inserted into the openings 2112 of the inner case (see FIGS. 2 and 5). Also, both the latches 2111 and the tabs 2222 urge against the assembled components in the first stage. As such, these components are fastened within the case 20. Thirdly, enclose the assembled components in the second stage and the cable enlargement 40 in the housing 30 so as to fasten them together by snapping the upper shell 31 to the lower shell 32. At this position, the detents 323 are urged by the branches 142. This finishes the assembly of the invention as shown in FIG. 1.

While the invention herein disclosed has been described by means of specific embodiments, numerous modifications and variations could be made thereto by those skilled in the art without departing from the scope and spirit of the invention set forth in the claims.

What is claimed is:

1. An electrical connector assembly comprising:

a first connector and a second connector wherein the first connector comprises a plastic housing, a metal case disposed in the plastic housing, a locking device disposed in the metal case and a first conductor assembly; and a second connector coupled to one end of the first connector, wherein the locking device comprises a structure including an insulating base, a support, and a second conductor assembly, and a U-shaped flexible member including a transverse member and two resilient members, the insulating base comprises a U-shaped tunnel formed at either side thereof, an elongated trough is formed along either side of the support, the troughs and the tunnels being coupled together to form a ground for resting the resilient members thereon when the insulating base and the support are coupled together, and the second connector comprises a slit in either side for locking the locking device.

2. The electrical connector assembly of claim 1, wherein the transverse member of the flexible member further comprises a raised portion, two side protrusions all matingly coupled to the insulating base, and two parallel branches, and either resilient member is coupled to the branch and comprises an end latch.

3. The electrical connector assembly of claim 1, wherein the insulating base comprises an upper body including a connecting element and a forward extension extended from the connecting element, a lower plate, a bent positioning member at either side of the insulating base, a U-shaped tunnel formed at either side of the lower plate, a lengthwise passageway formed on the lower plate to be in communication with the tunnel, and an indent provided at either side of the lower plate, and the support comprises a rear seat including a tab and a projection both at either side thereof, a front board, and an elongated trough provided along either side of the support to be matingly engaged with the tunnel.

4. The electrical connector assembly of claim 1, wherein the metal case comprises an inner case including a rear member, a front member for defining a space to receive the support, and a ramp interconnected the front and the rear members, and an outer case, wherein a slit is provided at either side of the front member with the latch of either resilient member projected therefrom a rib is provided on a bottom of the front member to insert into an elongated opening of the outer case for fastening the inner and the outer cases together, and the outer case comprises a forward recess provided at either side with the branch slidably disposed thereon, and a front opening shaped to substantially match the front member.

5. The electrical connector assembly of claim 1, wherein the housing comprises an upper shell and a lower shell, wherein the upper shell comprises a plurality of pegs, a plurality of recesses, and a plurality of latches, and the lower shell comprises a plurality of holes, a plurality of latches, and a plurality of recesses so that the upper and the lower shells are adapted to couple together by matingly engaging the pegs, the recesses, and the latches of the upper shell with the holes, the latches, and the recesses of the lower shell respectively.

6. The electrical connector assembly of claim 3, wherein the support and the second conductor assembly of the locking device are formed integrally by insert molding.

7. The electrical connector assembly of claim 3, wherein a groove is formed by either positioning member and a slot is formed in the groove.

8. The electrical connector assembly of claim 3, wherein the projections are inserted into the slots for fastening the support and the insulating base together.

* * * * *